US006117055A

United States Patent [19]

Boland

[11] Patent Number: 6,117,055

[45] Date of Patent: Sep. 12, 2000

[54] THIGH AND CHEST EXERCISE DEVICE

[76] Inventor: Kevin O'Brien Boland, 5623 Massachusetts Ave., Bethesda, Md. 20816

[21] Appl. No.: 09/131,017

[22] Filed: Aug. 7, 1998

Related U.S. Application Data

[60] Provisional application No. 60/056,294, Aug. 29, 1997, and provisional application No. 60/075,080, Feb. 18, 1998.

[51] Int. Cl.[7] ..... A63B 21/02

[52] U.S. Cl. ..... 482/121; 482/129; 482/130; 482/142

[58] Field of Search ..... 482/121, 123, 482/122, 148, 125, 126, 129–130, 142, 124, 908, 147, 112–113, 133, 136–138; 74/594.1, 44, 594.2, 594.4; 254/266

[56] References Cited

U.S. PATENT DOCUMENTS

| | | | |
|---|---|---|---|
| 5,066,004 | 11/1991 | Jones | 272/134 |
| 5,149,312 | 9/1992 | Croft et al. | 482/62 |
| 5,215,511 | 6/1993 | Cheng | 482/121 |
| 5,393,286 | 2/1995 | Cheng | 482/130 |
| 5,435,801 | 7/1995 | Hung | 482/130 |
| 5,569,138 | 10/1996 | Wang et al. | 482/130 |
| 5,593,140 | 1/1997 | Van Beers | 254/374 |
| 5,683,334 | 11/1997 | Webber | 482/100 |
| 5,779,601 | 7/1998 | Ish, III | 482/100 |

*Primary Examiner*—John Mulcahy
*Assistant Examiner*—Lori Baker
*Attorney, Agent, or Firm*—Arthur R. Eglington

[57] ABSTRACT

A multi-function exercise device having an elongate frame member with a conjoined seating component located on the frame and with the seating component adapted to lock into either of two operating positions facing the longitudinal ends. The forward-facing end has a pair of upstanding lever members adapted for manual arcuate movement having a set of resilient tensioning bands provided for a countervailing force for a first set of exercises. At the other frame end, is a vertical mast secured pivotally at its lower end to the frame member, and also provided with a upper end, manually actionable cross bar, for arm exercises. A pair of foot rests are mounted midway of the vertical mast for conducting certain leg exercises using a second set of tensioning bands which provide the countervailing force for the opposing end set of exercises.

10 Claims, 11 Drawing Sheets

THIGH AND CHEST EXERCISE DEVICE

CROSS REFERENCE TO OTHER FILINGS

This is a regular patent application submitted for an official filing receipt under 35 U.S. Code §111(b). It claims the effective date of two provisional patent applications titled: Chest and Thigh Exercise Device, under U.S. Ser. No. 60/056,294, filed Aug. 29, 1997, and Thigh and Chest Exercise Device, under U.S. Ser. No. 60/075,080, filed Feb. 18, 1998.

FIELD OF THE INVENTION

The present invention relates to a portable exercise device adapted for selective human muscle conditioning and development.

BACKGROUND OF THE INVENTION

The need for practical and affordable devices suitable for muscular toning and body conditioning is a well established one. There are a wide variety of available exercise machines, many of which focus on one conditioning, perhaps a second, related set of muscles conditioning. There are none presently known which are adaptable to provide one platform for the conditioning of two or even three exercises. U.S. Pat. No. 5,393,286, issued Feb. 28, 1995, discloses an elaborate machine which appears to effect two types of muscle conditioning: a scissors' unit for exercising the hands; a leg exercising unit, and a cooperating back rest unit to give a resisting force against the backward movement of the backrest by the legs.

Also, U.S. Pat. No. 5,518,482 (to Yi F. Hsieh) is directed to a chair based exercise device which permits working the gluteus maximus muscles, the top and back thigh muscles (FIG. 3), the inner thigh abductor muscles (FIG. 4), and outer thigh abductor muscles (FIG. 5).

It is a principal object of the present invention to provide a single exercise platform which provides for several types of exercise, all being combined into one portable and readily storable device.

Another object of the present invention is to provide a sit-down exercise device that in a first mode permits either inner/outer thigh abductors conditioning, and alternately, pectoral muscles (chest muscle) conditioning and rear shoulder toning; respectively, employing dual, specially-configured lever arms.

It is another object of the present invention that with a facile shift of the seat that the device, permits either bench pressing or leg pressing exercises.

It is still another object of the present invention is to provide a combination exercise platform in which the mast component is movable arcuately to provide a resistance force when in the leg-pressing mode or in the bench-pressing mode.

Another object of the intention is to provide a mid-station, attached currently to the rear of the chair, permitting a series of exercises from both a sitting or a standing position using one or more easily attached tensioning bands.

A yet further object of the present invention is to provide a multiple-role exercise device which can be made portable and compacted for convenient storage when not in use.

SUMMARY OF THE INVENTION

According to the invention, there is provided a multi-function exercise device comprising: an first elongate rigid base frame member having a conjoined seat and backrest disposed thereon which are located intermediate the longitudinal ends of the base frame, with the seat and backrest being adapted to swivel and hold positions facing either longitudinal end; the longitudinal ends of the first frame member each have a depending leg terminating in a transversely-aligned, floor member, which members provide lateral stability to the first base member; an second elongate rigid frame member aligned at right angles to the first frame member and pinned at its center point thereto; a third and fourth depending legs affixed at the longitudinal ends of the second elongate member, each terminating in a length sufficient to contact the supporting floor, and to provide added lateral stability to the first and second base members; a spaced-apart, upstanding pair of rigid lever members, each being secured at its lower longitudinal end to one proximal end of a pair of laterally-aligned, horizontal support arms; the horizontal support arms at their other distal longitudinal ends being pivotally attached to the longitudinal ends of the second frame member; a pair of horizontally-aligned, resilient tension bands, each positioned between the distal longitudinal end of the lateral support arms and a second anchor point located proximal the horizontal longitudinal ends of the second frame member; a substantially vertical mast secured at the distal longitudinal end of the first frame member; an elongate first cross-member, secured centrally on the upper longitudinal end of the vertical mast; a pair of spaced-apart, foot rests mounted horizontally and laterally, of either side of the vertical mast proximal to the distal longitudinal end of the first frame member; a tensioning means comprising a pair of laterally-disposed tensioning bands, spaced apart, being positioned in the plane of between the first frame member and the vertical mast; and connected to the first frame member proximal to its distal longitudinal end. In a preferred embodiment, each of the upstanding pair of members are provided with an arcuate bend intermediate their longitudinal ends, which shifts the upper ends of the members spatially closer to the user than are the supported lower ends. In an alternate embodiment, the tensioning means comprises a single hydraulic cylinder, having its rigid rod projecting in a directionally-biased manner with the free end of the rigid rod operatively engaging the vertical mast, and the opposing support end of the hydraulic cylinder pivotally connected to the first frame member.

DESCRIPTION OF A PREFERRED EMBODIMENT

Figure 1:
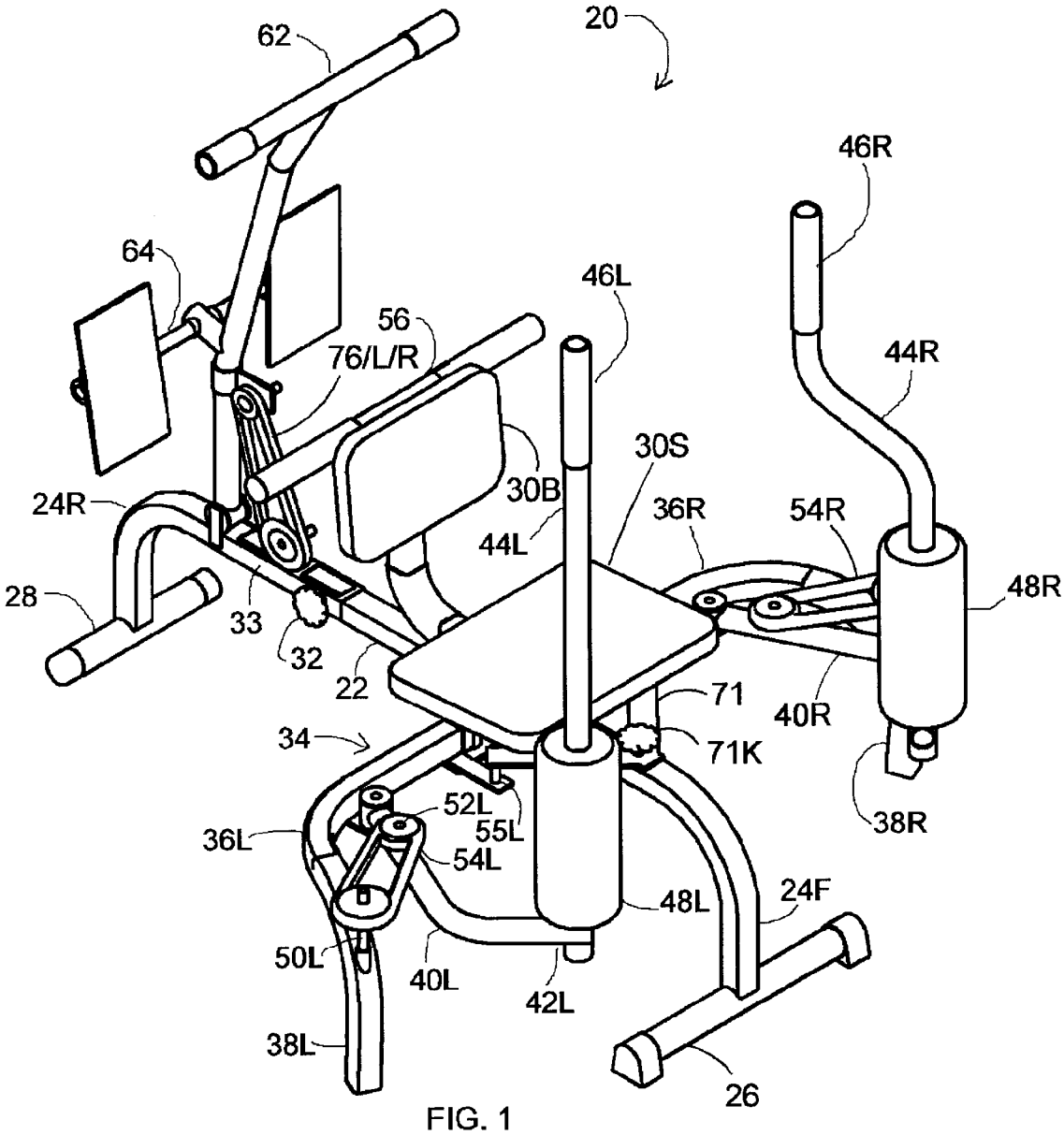
FIG. 1 is a perspective view of the exercise device constructed in accordance with the principles of the invention with a first position for tensioning bands, seen from a frontal angle.
Figure 2:
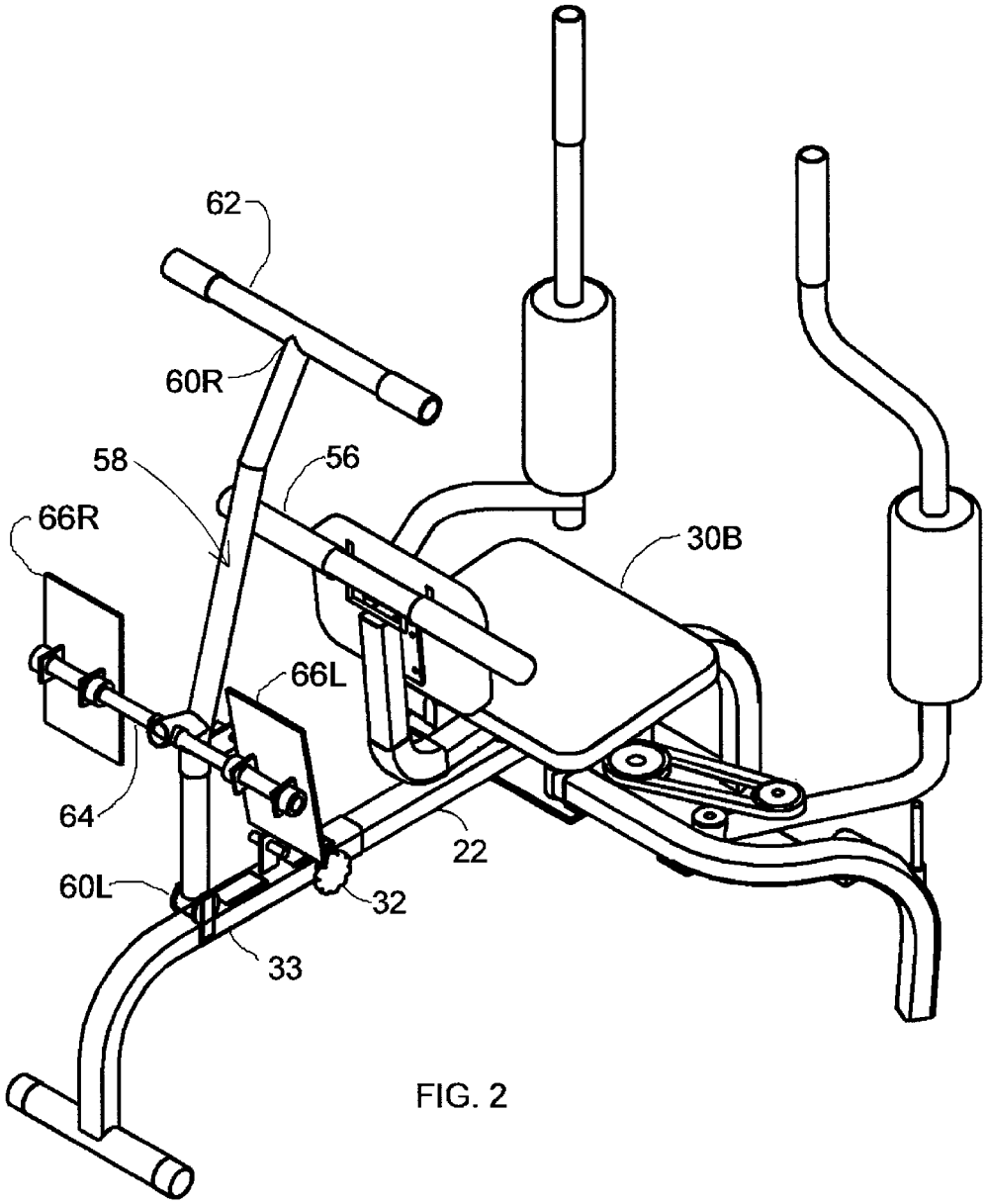
FIG. 2 is another perspective view of the device of FIG. 1 seen from a rearward angle still with a first position for tensioning bands.

Referring now to the drawing, and to FIG. 1 in particular, the exercise device 20 of the present invention is depicted in a first (forwardly-facing) mode of operation. An elongate rigid frame 22, (variable length) has arcuately bowed, longitudinal ends 24F and 24R, which terminate in floor-based, cross members 26 and 28, with the forward member 26 having a somewhat longer transverse span, due to the nature and spacing of the device components that it supports. Located intermediate of the longitudinal leg-like ends 24F and 24R of frame 22 is a two element, seating component, 30S and 30B, as shown in FIG. 2. Seat pad 30S is secured to an underlying, generally rectangular frame (not seen), which frame is also provided with an interruptible, lock-in-place, knob (also not seen) that will hold the seating component 30, either in the position depicted in FIG. 1, or in the alternate functional position, depicted in FIG. 5, when another set of exercises come into play. Note knob 32 which permits for a variable position lock of channel 33 (to be described) on the telescoping main frame 22.

Figure 3:
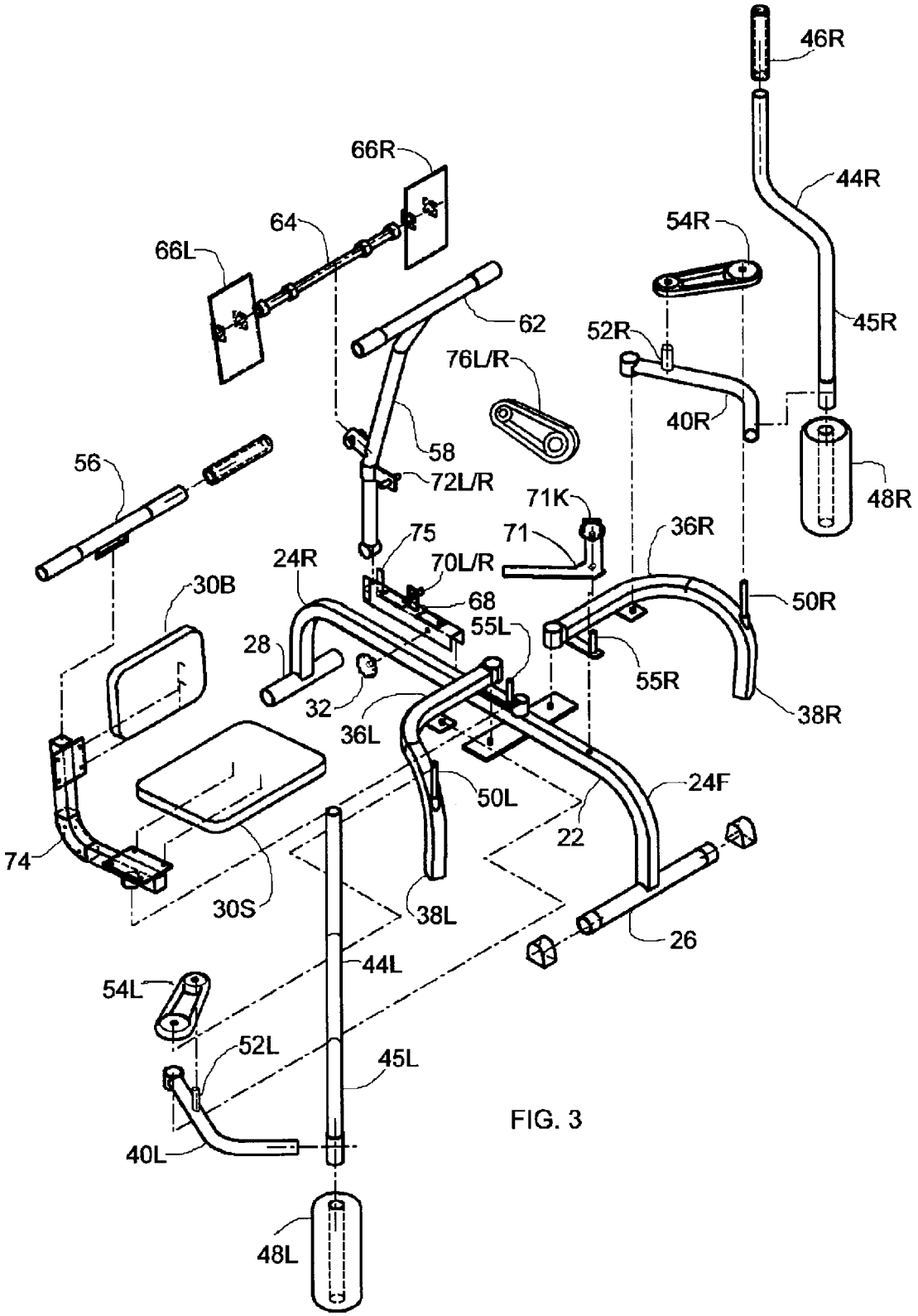
FIG. 3 is an exploded perspective view of the device showing all of the major components of this multi-action exercise device but omitting the proximal side upright arm.
Figure 4:
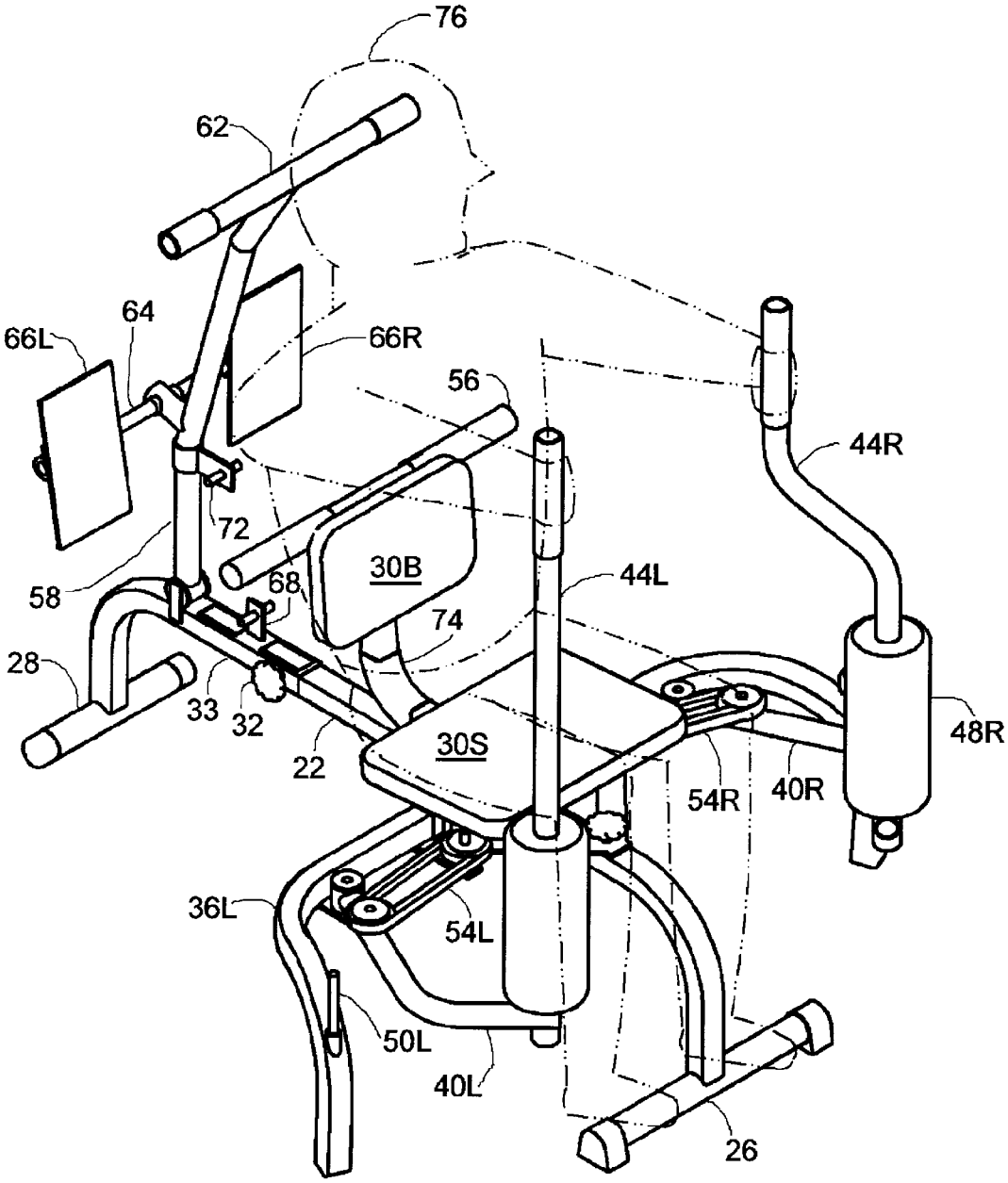
FIG. 4 is a perspective view (with a user shown in phantom) illustrating use of the device in the tensioning mode of FIG. 1, for working of the chest muscles (lateral pectoral flies shown) with an arm-scissors motion.

A third elongate cross member 34 is pinned intermediate the ends of frame member 22 and is disposed proximal, and under, seat element 30S. Each outwardly-extending lateral extension (36L/R) of member 34 has a depending leg, 38L and 38R, which provides further lateral stability to device 20 (FIG. 3). Pivotably-connected to the horizontal segments, 36L and 36R, of the lateral arms are a pair of forwardly extending, somewhat bowed members 40L and 40R as shown in FIG. 4. The free outer ends, 42L and 42R, of bowed members, 40L/R, have mounted axially and securely thereupon, a pair of upright rigid arms, 44L and 44R (also S-shaped), which terminate at their upper ends, leg-like at about the shoulders level of a seated user (see FIG. 4). Each upright upper end is provided with a snugly-fitting elastomeric sleeve, 46L and 46R, to ease manual gripping. Proximal the lower longitudinal ends of upright arms 44L and 44R are enlarged, resilient sleeves 48L and 48R (such as of flexible foam, see FIG. 2). They are provided to cushion the user limb pressure contact occurring during certain exercises, to be described.

Fixed pivot pins (50L/R of FIG. 3) are provided on each adjacent pair of lateral leg extensions 38L and 38R and also another pin set on pivoting bowed members, 40L and 40R, on which upright pins (52L/R) serve as the straddling points for resilient tensioning bands 54L and 54R (FIG. 1). The bands provide the escalating countertension to certain of the exercises, to be described, and they allow for return of the upright arms (44L/R) to an at rest position (FIG. 1), upon manual release. Pins 55L/R (FIG. 3) are the alternate anchoring points on arms 36L/R. At the other longitudinal end of elongate frame 22, several other components (to be described) are usefully employed, when the device seating is aligned in the mode depicted in FIG. 5.

Secured to the seat back element 30B of seating component 30 is an extensible cross bar 56, which rests on the top of the chambered (FIG. 6), vertical post 74 that supports the seat back itself, and which post will be described in detail in relation to FIGS. 6 and 12.

Located proximal to the rearward leg end 24R of elongate frame 22 are a combination of features, that provide for a plurality of exercises: triceps extension, bench press, leg extension, and calf press (see composite FIG. 8). All are conductable while having the user in the seating component, pivoted to the rearward alignment, like in the mode of FIG. 5.

FIG. 2 depicts a substantially vertical mast 58, secured pivotally at its lower longitudinal end 60L, proximal to the rearward longitudinal end 24R upon inverted U-shaped channel 33. A horizontally-oriented, rigid cross member 62, sized for manual grasping, is secured centrally thereof, and proximal to, upper longitudinal end 60R of vertical mast 58. Mounted intermediate of the longitudinal ends of mast 58, but more proximal to its lower end, is a horizontal, rigid cross member 64, to which are pinned a pivotable pair of planar foot rests, 66L and 66R. These rests permit the foot/leg directed, reciprocal arcuate action of upon vertical mast 58.

In the exploded view of FIG. 3, all the operative device elements of FIGS. 1 and 2, (same lateral extension 34L) are depicted, including the arms mounted, anchoring Pin sets, 50L/R, and 52L/R, located on the forward components; lateral extension mounted pins 55L/R; and the frame 22 and mast 58- mounted-pins, 70L, 70R and 72L/R, respectively, located on the rearwardly facing components. L-Shaped element 71 braces the set positions of lateral legs 36L/R.

When the forward set of tensioning bands, 54L/R, are connected between lugs, 50L/R, on the intermediate cross member and to arm lug 52L/R on the forwardly-oriented, horizontal arm 40, then leg scissors gripping of upright members 44L/R produces a resistance, when the upright arms are turned inwardly (inner thighs). When the forward set of tensioning bands (54L/R) are connected between extension set of lugs 50L/R and innermost set of lugs 55L/R, an outwardly scissors motion provides a resistance to upright arm divergence (the outer thigh exercise). When the first set of tensioning bands are connected between pins 52L/R and pins 55L/R, the outward hand extension of upright arms 44L/R produces the lateral flies exercise. L-shaped member 71 is end mounted upon pins 55L/R and centrally mounted at front leg 24F by knob-headed, bolt 71K.

Positioned along frame member 22 is located an inverted, U-shaped, rigid channel member 33, provided with an external knob 32, the axial pin of which knob (not seen) traverses the skirt segment of channel 33. The knob position interruptibly locks channel member 33 into a variable position along frame 22, contingent upon the natural leg extension of a device user. Located intermediate the upper length of inverted channel 33 is a vertical lug 68 bearing a transverse anchor pin 70L/R. At the rearward longitudinal end of channel 33 is a fixed, but hinged, mounting bracket 75, to which is tied the lower longitudinal end of arcuate mast 58. The spatial gap between channel mounted anchor pins, 70L/R, and mast-mounted anchor pins, 72L/R, will necessarily vary with the specific, locked position of channel 33 along frame 22. When the rearward set of tensioning bands, like 76L/R, (FIG. 5) are linked between frame lugs 70 and mast lugs 72, then another set rearward seated exercises are available. L-Shaped rod 73 (FIG. 3) serves as a reinforcing bracket between frame 22 and upright pins 55L/R. L-Shaped tubular member 74 (with mounting brackets for seat components) is also the elongate chamber for the assembly of FIG. 6.

In the schematic view of FIG. 4, is shown a forward facing mode of conducting the inner chest (lateral flies exercise). Phantom user 76 braces her feet upon forward floor bar 26, grasps uprights 44L/R, and manually exerts outward force against them, which is countered by tensioning bands 54L and 54R. By rearranging the anchoring points of the bands, so as to be anchored between lugs 5OL/R and 52L/R (FIG. 1), the pectoral flies exercise of FIG. 8E may be conducted, involving forced inward convergence of the upright arms 44.

Figure 5:
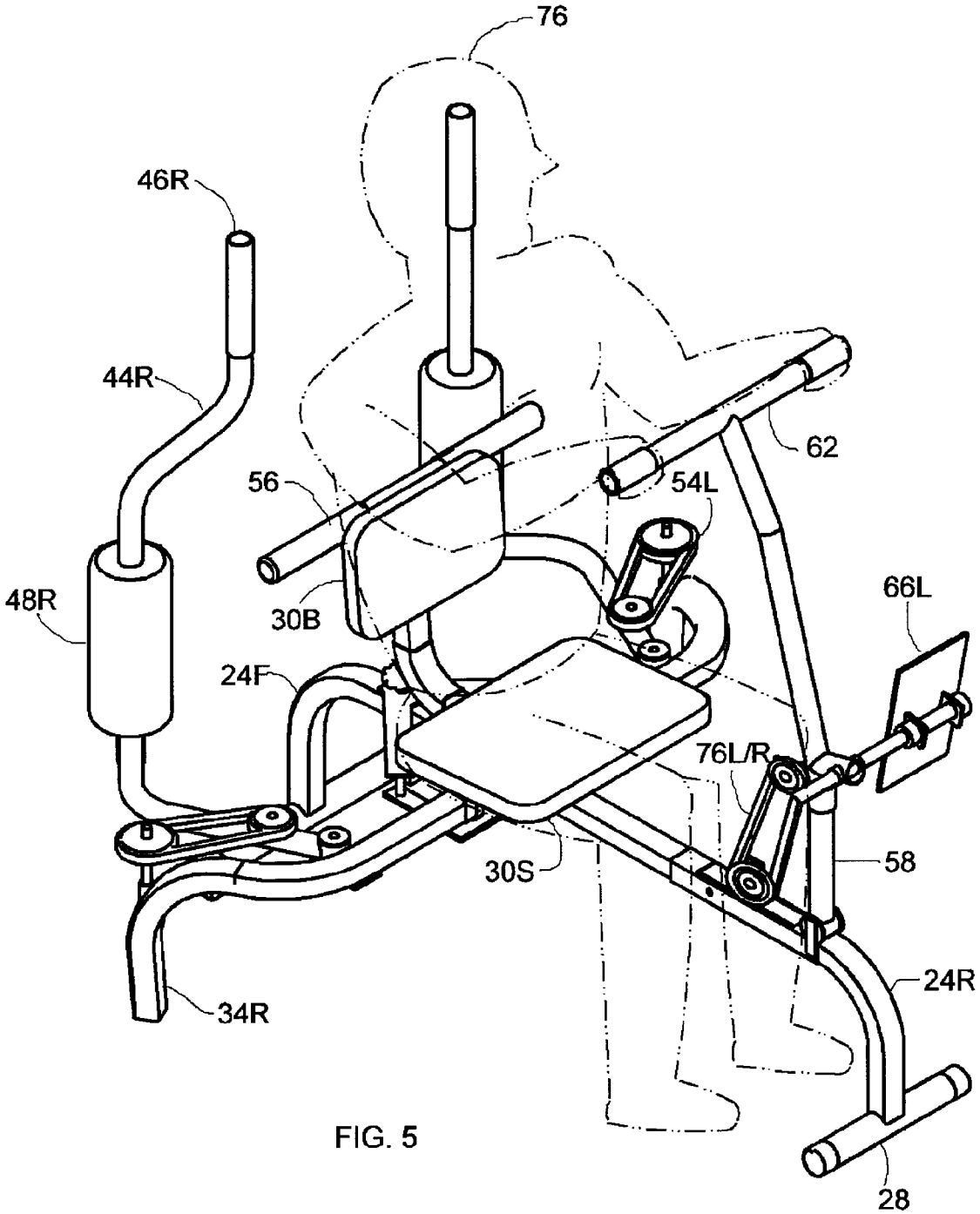
FIG. 5 is a perspective view (with user shown in phantom) with the seating component, aligned in the converse mode, illustrating the use of the present device for working the pecs muscles (bench press) by an arms outward motion.

In the schematic of FIG. 5, with the seating component 30 aligned in the converse mode, then by manually grasping cross bar 62, a bench press exercise is being conducted, by pushing outwardly on the upper cross bar 62 against a vertically aligned, second set of countervailing tensioning bands 76L/R. By changing hand position, the triceps extension exercise of FIG. 8A may be conducted. These are the arms and chest exercises available for use with this specific device configuration. While the user is seated rearwardly, also either of the military press or the shoulder raise are carried out. Foot rest 66R is omitted for clarity of view.

Figure 6:
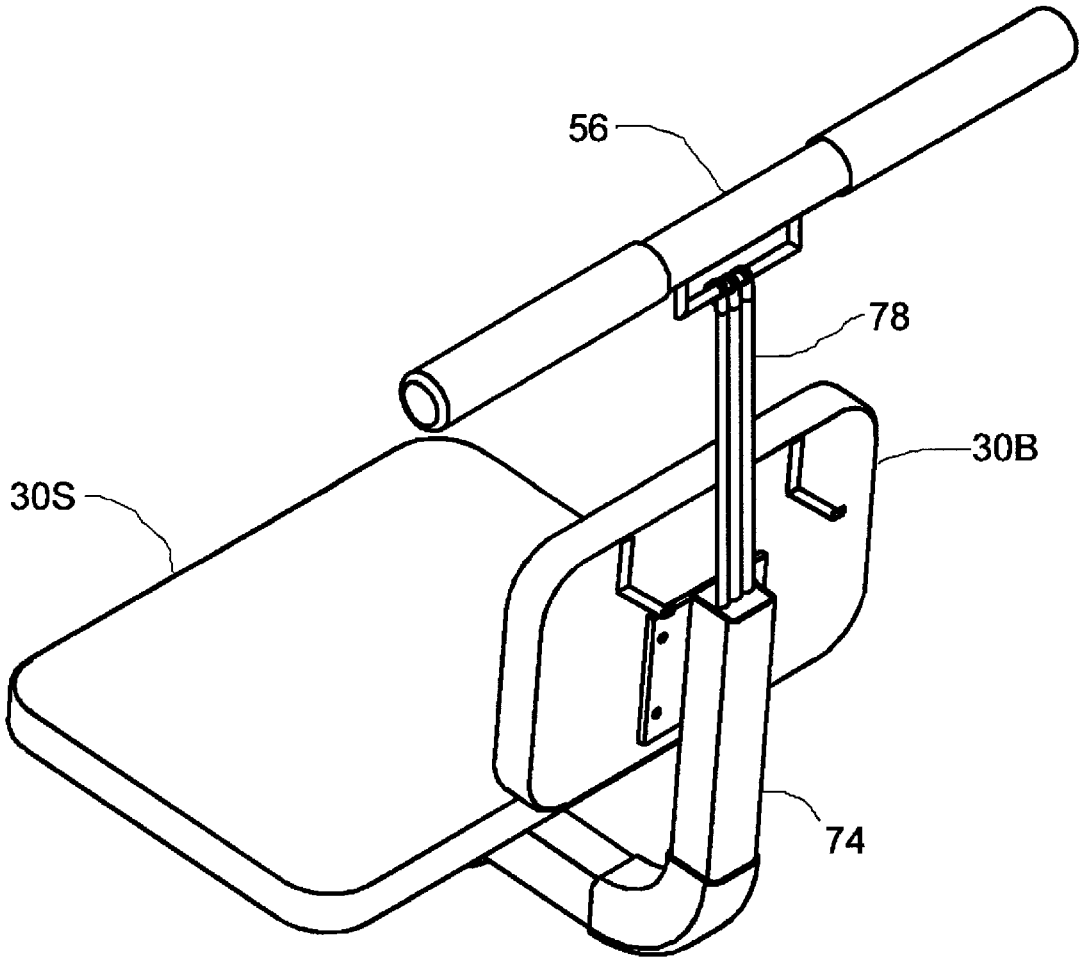
FIG. 6 is a broken away perspective view of the seating component of the exercise device with an accessory component anchored behind the device seat, presenting a lift bar, and connected bungee-cord-type extensor assembly, useful for any of the standing curl, military press, upright row and shoulder raise exercises.
Figure 7:
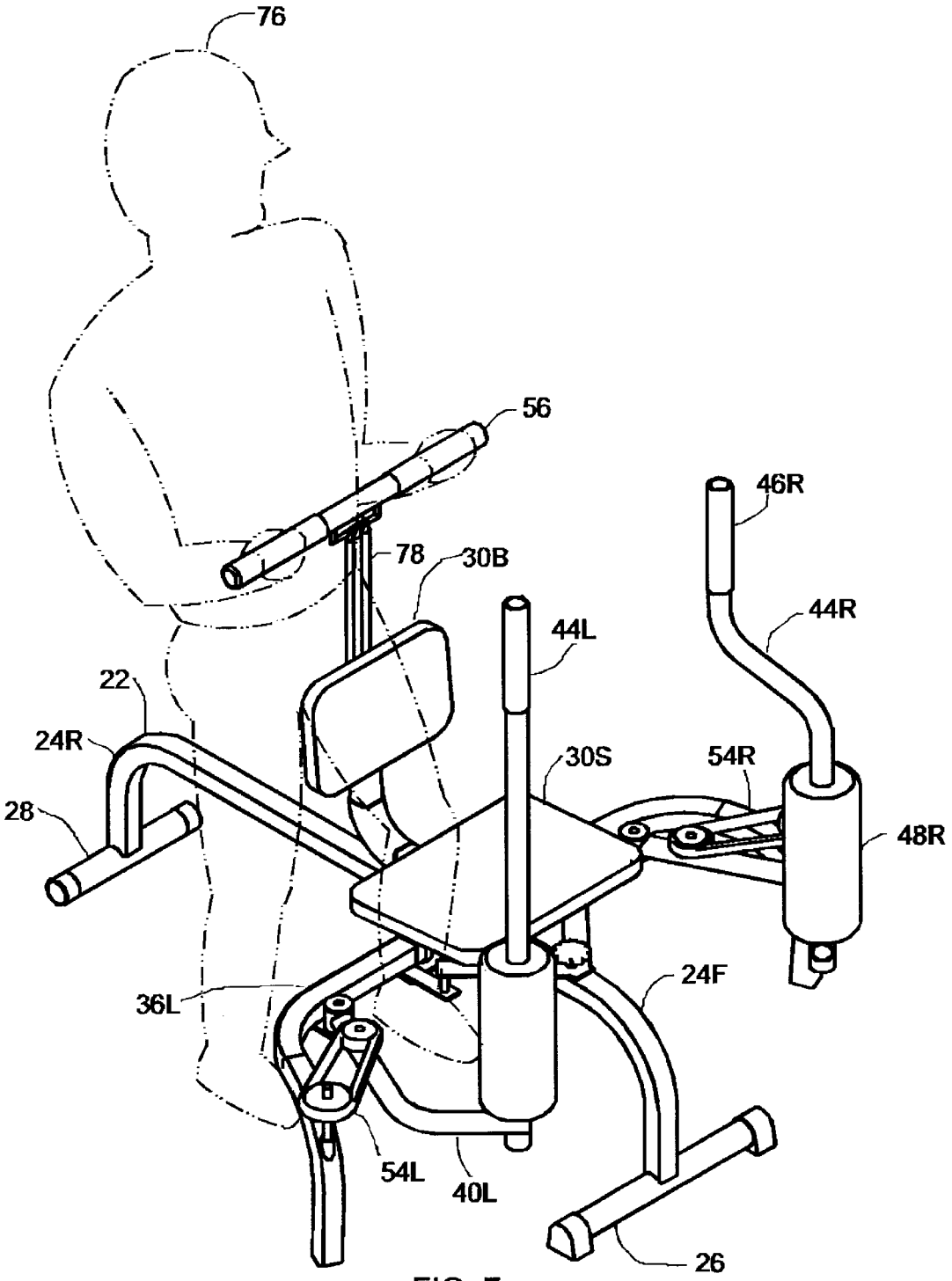
FIG. 7 is another perspective view (user also shown in phantom) illustrating use of the present device for conduct of the standing curl exercise.
Figure 8A:
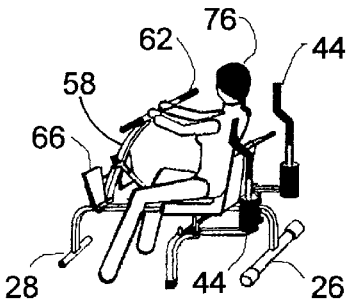
FIGS. 8A through 8I depict a series of schematic views of a user employing the device in a plurality of other exercises involving arms (A/B); shoulders (C/D); chest (E); and legs (F/G/H/I)
Figure 8B:
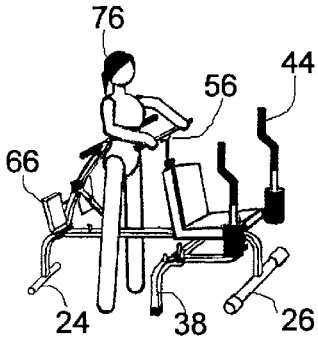
Figure 8C:
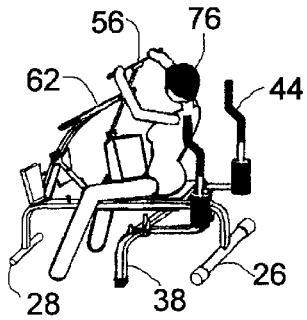
Figure 8D:
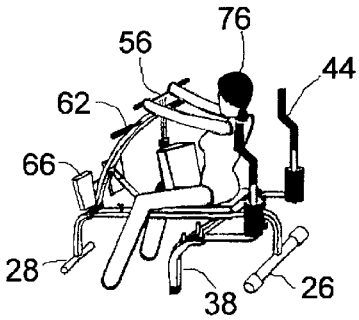
Figure 8E:
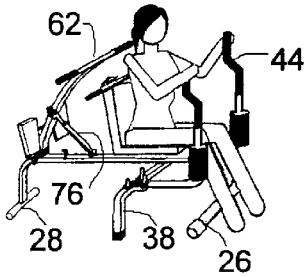
Figure 8F:
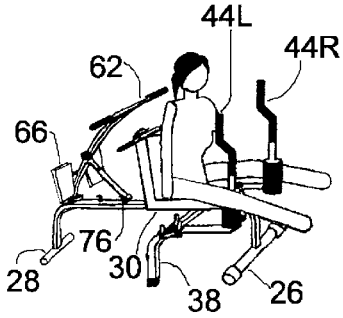
Figure 8G:
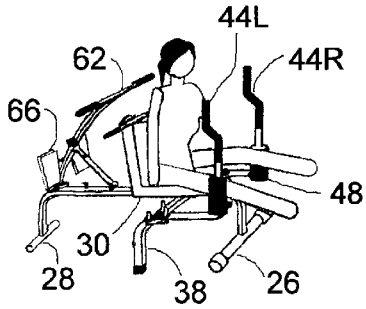
Figure 8H:
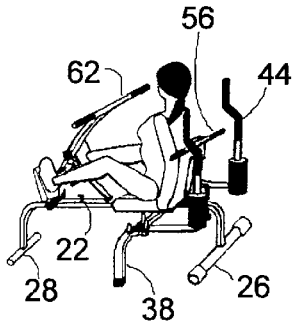
Figure 8I:
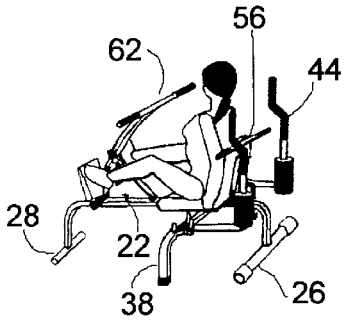

The broken away perspective view of FIG. 6 provides a detail of the plural bungee-cord (78) controlled type of intermediate extensionable bar 56 configuration that supports the standing curl exercise of FIG. 7, the upright row of FIGS. 8B, the military press exercise of FIG. 8C, and the shoulder raise exercise of FIG. 8D. Horizontal bar 56, at rest, is depicted in FIGS. 1, 2, and 4.

In FIG. 7, a perspective view of the standing curl exercise, with hand oriented palms-upward, is depicted in finer detail. (The rearward end components are omitted for clarity.) While the user straddles the frame 22, standing behind seat back 30B, then grasping cross bar 56 for either the standing curl, or the upright row are carried out. The inherent contractive resilience of the bungee cord(s) set 78, will retract bar 56 to be tucked behind seat back 30B during other exercises, once the depicted upward manual exertion thereon is terminated.

In the composite schematic views of FIG. 8, all nine of the exercises, not already seen in FIGS. 4, 5, and 7, are depicted. The forward-standing exercises are: the upright row (FIG. 8B). The forward seated are: the pectoral flies (FIG. 8E); the inner thighs (FIG. 8F); and the outer thighs (FIG. 8G). the rearward seated exercises are: the triceps extension (FIG. 8A); the military press (FIG. 8C); the shoulder raise (FIG. 8D); the leg extension (FIG. 8H); and the calf press (FIG. 8I).

Figure 9:
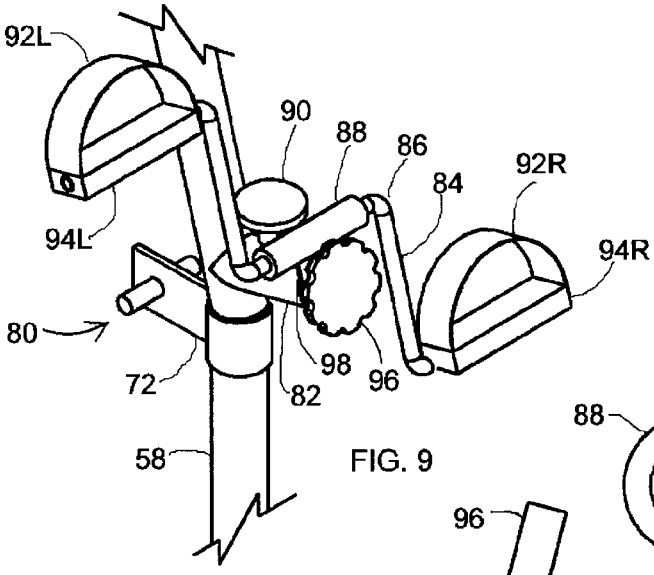
FIG. 9 is a broken out, perspective view of an alternate arrangement for the pedaling subassembly mounted upon the lower mast carrying the horizontal cross bar.

In the broken out, perspective view of FIG. 9, an accessory, generally 80, is depicted, which will convert part of the device of FIG. 1 to a recumbent bicycle exercise, mainly by spaced pedals, which are substituted for the flat foot rests (66L/R) of FIGS. 1 and 2. A mounting stud 82, integral with vertical mast 58, is freed of its support bar 64, and also of its associated flat foot rests. It is replaced by an S-shaped member 84 (substantially identical to the pedal support members on a standard bicycle). Rigid member linear section 86, is retained rotatably within machined horizontal sleeve 88, which sleeve has a peripherally-located, top side tensioning knob 90. Knob 90 will preset the degree of pedaling resistance during exercise. A pair of looped bands (92L/R), pedals 94L and 94R are pivotably mounted on the longitudinal ends of S-member 84. Underside knob 96 affixes the depending planar segment 98 of sleeve member 88 to the mast-mounted stud 82. Arcuate mast 58 itself is identical to FIGS. 1 et seq., retaining the lower end, pivotal mounted axle 60L union on the elongate frame member 22.

Figure 10:
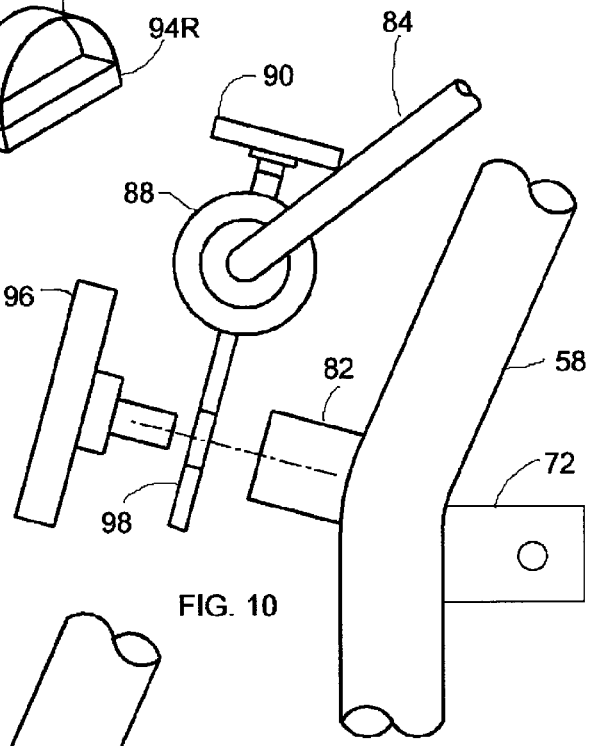
FIG. 10 is a broken out, side elevational view of certain components for the pedal attachment assembly of FIG. 9.
Figure 11:
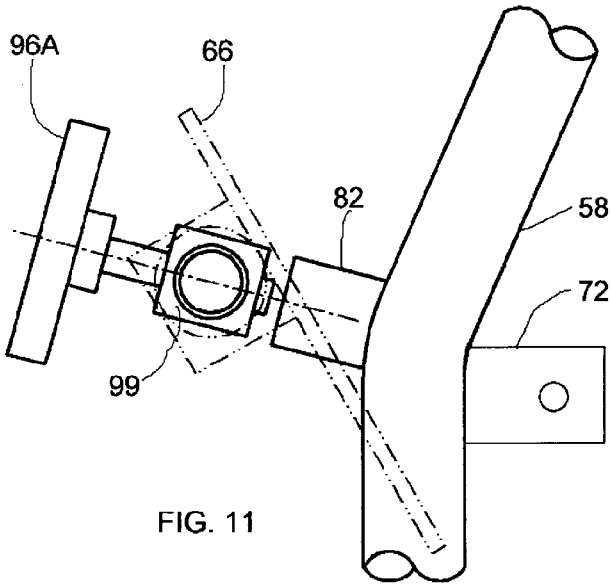
FIG. 11 is a broken out, side elevational view depicting a means of detaching the leg press planar pedals of FIG. 2, for replacement by the alternate rotating pedals of FIG. 9.

FIG. 10 provides a side elevation view of the bicycle-like pedaling sub-assembly 80 of FIG. 9. In FIG. 11 is seen the first step in its detaching of its foot rest assembly (64/66) of FIG. 2 from vertical mast 58. The left hand knob 96A serves to secure the foot rest assembly to the mast, while the flat panels 66 are free to pivot arcuately on axle 99.

Figure 12A:
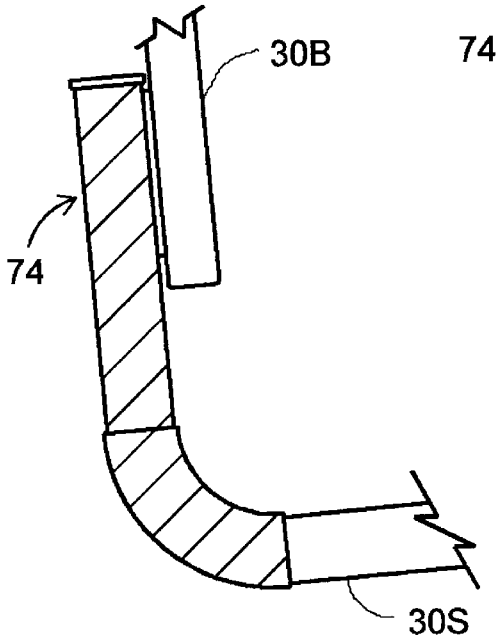
FIG. 12A is a broken out, partial vertical sectional view of the dual function seating component.
Figure 12B:
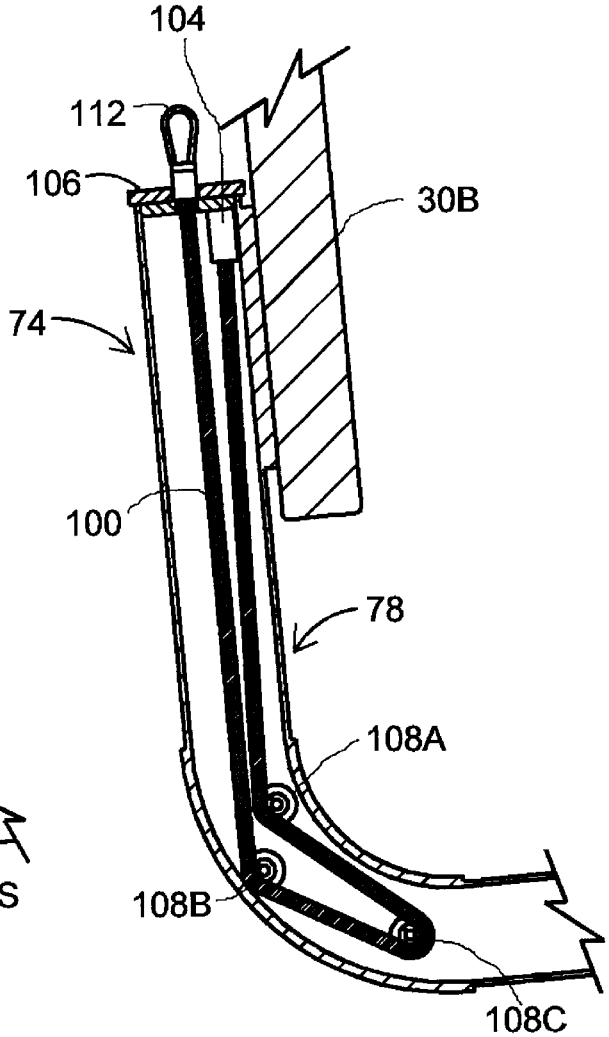
FIG. 12B is a broken out, vertical sectional view of the bungee cords subassembly feature, to be used in the standing curl, upright row, military press, and shoulder raise exercises of FIG. 8; and, FIG. 13 is a broken out vertical sectional view showing the telescoping main frame and the elbow segment of the bungee cords chamber of the seating component.

In FIG. 12A is a broken away fragmentary view of the seating component 30 of FIG. 6, showing how vertical back support frame 74 attaches to back cushion 30B. Chambered member 74 is depicted in the vertical sectional view of FIG. 12B. Bungee cord(s) 78 are tied at one longitudinal end 104 to cover plate 106. After extending about, internally and axially, smaller capstans 108A/B and C, the free longitudinal end 100 extends through cover plate 106, presenting looped connector 112, to which the intermediate bar 56 of FIG. 6 is secured.

Figure 13:
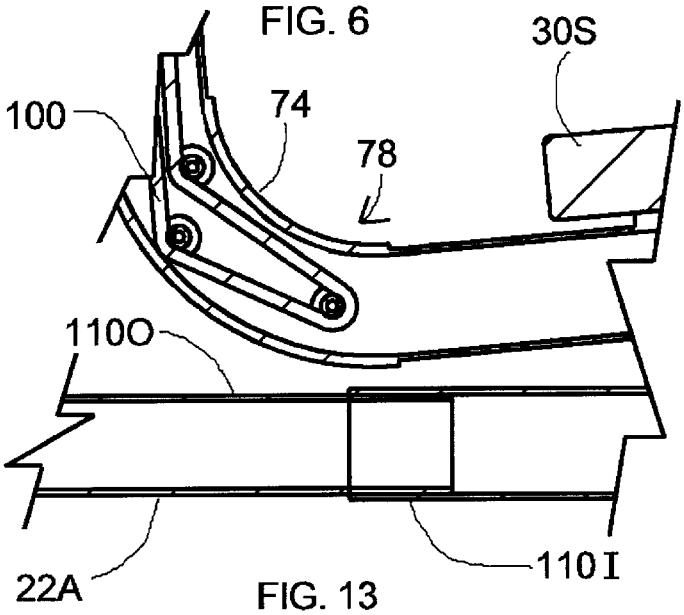

In FIG. 13 is depicted the optional configuration of elongate frame 22A. It can comprise two open ends 110 O/110I, which are adapted to telescope, permitting variable length for main frame 22A.

Figure 14:
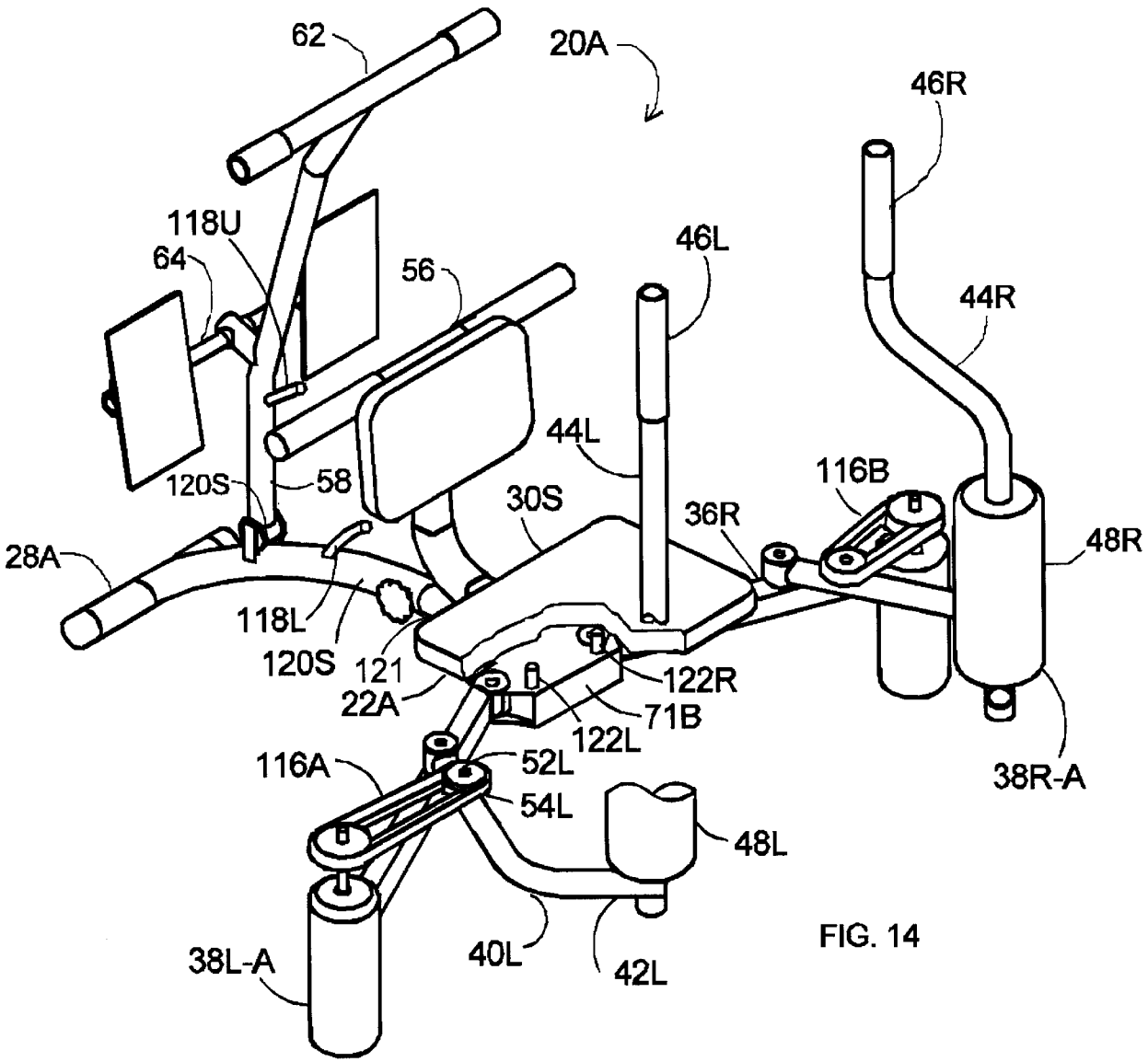
FIG. 14 is a perspective view of another embodiment of the exercise device, like that of FIG. 1, but without the forwardly projecting front leg, leaving tripod-like legs for device stability, and a somewhat modified resilient bands anchoring rings.

In the alternative embodiment of FIG. 14, the exercise device 20A has been modified to omit the forward leg 26 depicted in FIGS. 1–3, thus relying effectively upon a tripod-style support, as now presented by rearward floor bar 28A, and laterally-aligned, opposing floor legs, 38L-A and 38R-A. The need for the underseat, legs-anchoring, triangular frame 71 of FIG. 1 has been superseded with the omission of the forwardly projecting leg 26. Frame 71 is replaced by a fork-like engaging bracket 71B with locking knob 71K.

An added frame configuration modification involves the telescoping structure, 110 O/110 I, of elongate horizontal member 22A seen in the partial sectional view of FIG. 13. Member 22 in FIGS. 1/2 is modified so as to replace the separable movable channel member 33 riding thereon. As depicted in FIG. 14, squared member 33 is replaced by one of a tubular, inner-end, cross configuration for the horizontal segment of rearward support frame 24R. Substitute tubular member 120S is sized to telescopically engage the rearward-facing, free end 121 of forwardly-located, underseat tubular member 22A. Knurled knob 32A locks this variable elongate position. Rigid hooks, 118L/U, are anchored on frame members 120S and 58, respectively. Such lugs support paired resilient bands, 116A/B, which are essentially identical to resilient bands, 76L/R, in the exploded view of FIG. 3.

Underseat retaining bracket 71B is also provided with two spaced apart, vertical pins, 122L/R, which pins serve as the alternative anchor points for resilient tensioning bands, 116A/B, when conducting those exercises associated with the device in the configuration of FIG. 2 (inward band rigging). The vertically-oriented bands 74L/R of FIG. 1 have been omitted for clarity so as to depict the mast/main frame anchoring lugs 122L/R.

EXERCISE DEVICE DIMENSIONS AND MATERIALS OF CONSTRUCTION FOR A PREFERRED EMBODIMENT

The base dimensions of one operative device 20 are 51" long and 36" wide. Main elongate frame 22 is a 1.375" squared cross section, of tubular metal, terminating in a forward, horizontal cross tubular base 26 which is 17" wide and of a 1.5" diameter. The rearward horizontal cross base 28 is c. 10" wide and also of 1.25" diameter tubing. The seating component (not seen) has a frame of 1.75" squared tubing, with a generally rectangular, back rest of like tubing. A foam back pad 30B of 14" by 8" by 1.35" thick. The seat cushion 30S is 12" long by 16," by 1.78" thick. The larger intermediate cross member 36L/R is about 22" for its horizontal segment, the arcuate segments are about 7" and the vertical feet are 12" long, all being of 1.125" of squared tubing. The pivoted, forwardly extending, horizontal arms, 40L and 40R, are of 1.08" diameter tubing, have a 13" linear segment, and a 5" arcuate segment. Mounted upon them are paired vertical masts 44L and 44R, which are of 1" diameter, and are about 26" in overall length, with an 11" linear lower segment 45 secured to the horizontal arms 46L/R, an intermediate 6" inclined segment, and a 9" upper linear segment. Resilient (bolster) sleeves, (48L/R ) are formed of foamed elastomer and the upper end manual grips 46L/R are of a formed sleeve about 6" in length. The paired forward power bands 54L and 54R, composed of rubber, are about 10" elongate length when at rest. Transversely-aligned rigid lugs 50L/R are anchoring points for the forward end components, like tensioning bands 54L/R. Vertically-aligned lugs 72L/R and 72L/R are anchoring points for the rearwardly aligned tensioning bands (not seen in FIG. 1). The lugs are 3.5" overall in length. Intermediate curl bar 62 (mounted abutting the upper edge of seat back 30B) is 22" long. The arcuate vertical mast 58 is 28" long, and its upper mounted, cross bar 62 is 24" long, both being of 1" diameter tubing. The intermediate level pedal support bar 64 on mast 58 is 15" long and of 0.5" in diameter. It supports planar foot rests 64L and 64R, which are 9" by 5" and about 0.25" thick. When the foot rests are replaced by bicycle pedals, the latter pair are of a standard adult bike size, as depicted in FIG. 9. This provides a reclining bicycle exercise.

What is claimed is:

1. A multiple exercise device comprising:

(a) an elongate rigid frame member having a pair of transversely located cross members, each of the first and second cross members pinned at one frame longitudinal end and aligned to support the frame member on an essentially horizontal surface;

(b) a seating component comprising a user seat and associated back rest, located intermediate of the longitudinal ends of the rigid frame members, being structured so as to be pivoted into one of a forward and rearward lockable positions while in use;

(c) a third cross member located transversely of and proximal to the forward longitudinal end of the elongate frame member, for added device support on the horizontal surface, further with the third cross member being located proximal to the user seat;

(d) a first pair of rigid forwardly-extending, members, disposed horizontally and each having one inner longitudinal end mounted pivotally on opposing lateral segments of the third cross member, with each such extending member inner end being located proximal to the user seat;

(e) a second pair of upright arms, with each arm being mounted at the free outer ends of the pair of forwardly extending members, located spatially so as to be within the manual grasp of the extended arms of a device user, and useable while the seat is pivoted to the forwardly-facing mode of seating;

(f) a first tensioning means operatively associated with each of the forwardly extending members for yieldably biasing of the pair of upright arms to a spaced-apart, at rest position, and configured to provide a arcuate range of motion, and for allowing return of said pair of upright arms upon release of the biasing effort;

(g) a combined chest press and leg press exercise subassembly located proximal to the rearward longitudinal end of the elongate frame member, and useable while having the seating component pivoted lockably into the rearwardly-facing mode; the subassembly further comprising:

(i) a substantially vertical mast secured pivotally at its lower longitudinal end proximal to the rearward longitudinal end of the elongate frame member;

(ii) a horizontally oriented, fourth cross member secured centrally of being proximal to the upper longitudinal end of the vertical mast;

(iii) a second tensioning means operatively linked between a first anchor point located intermediate of the longitudinal ends of the vertical mast and a lower second point located intermediate of the rearward longitudinal end of the frame member and the seating component, normally biasing the vertical mast towards the seating component, and further adapted for bench pressing by moving the mast in an arcuate range of motion as initiated by the user arms.

2. The device of claim 1 wherein the first tensioning means comprises a pair of laterally-disposed tensioning bands, spaced apart, and located so to operatively link the first pair of extending members to the supporting third cross member.

3. The device of claim 1 wherein the leg exercising unit comprises a pair of laterally-disposed, foot platforms arrayed straddling the mast and pivotally mounted on a first cross rod which is pinned intermediate of the longitudinal ends of the vertical mast.

4. The device of claim 1 wherein the third cross member is provided with downwardly-bowed longitudinal ends serving as legs contacting a horizontal surface.

5. The device of claim 1 wherein the third cross member is positioned and pinned underlying the seating component.

6. The device of claim 1 wherein the leg exercising unit comprises a pair of laterally-disposed set of bicycle pedals operatively associated with a Z-shaped rod that is pivotally mounted on a first cross rod which is pinned intermediate of the longitudinal ends of the vertical mast.

7. The device of claim 1 wherein the back rest element of the seating component is adapted to provide a recessed internal chamber, in which is located an extensible, tensioning band that is pinned at its outer longitudinal end centrally of a rigid fifth cross member, with the latter adapted for manual grasping, and the band further comprising:

(i) one or more parallel, elastic resilient cables anchored at the inner longitudinal ends to an inner wall of the chamber;

(ii) two or more transversely aligned, and axially mounted within the chamber, rotatable capstans, over which the bungee cords will loopingly slide when a drawing force is exerted upon the outer longitudinal end of the band providing increasing resistance to such manual force, and adapted, upon release, to reel back into the chamber, leaving only the outer end of the tensioning band exposed while pinned to the cross member.

8. The device of claim 1 wherein the pair of upright arms are each provided with an intermediate bent segment that provides for a lateral offset between the upper and lower longitudinal ends.

9. The device of claim 1 wherein a leg exercising unit is connected proximal to the lower longitudinal end of the mast, located on a first cross rod secured transversely to the mast, with said unit being configured for yieldable movement of the mast in an arcuate range of motion as is initiated by action of the user legs.

10. A multiple exercise device comprising:

(a) an elongate rigid frame member having at least one transversely and rearwardly located cross member, such cross member being pinned at one longitudinal end and aligned to support the frame member on an essentially horizontal surface;

(b) a seating component comprising a user seat and associated back rest, located intermediate of the longitudinal ends of the rigid frame members, being structured so as to be pivoted into one of a forward and rearward lockable positions while in use;

(c) a second cross member located transversely of and proximal to the forward longitudinal end of the elongate frame member with a vertically-aligned leg pinned to each of the longitudinal ends of the second cross member, for presenting a tripod leg device for support on the horizontal surface, further with the second cross member being located proximal to the user seat;

(d) a first pair of forwardly extending members, each disposed horizontally, and each having one inner longitudinal end mounted pivotally on opposing lateral segments of the second cross member, with the inner longitudinal end of each such extending member being located proximal to the user seat;

(e) a second pair of upright arms, with the lower end of each arm being mounted at the free outer end of the pair of forwardly extending members, located spatially so as to be within the manual grasp of the extended arms of a device user, and being graspable while the seat is pivoted to the forwardly- facing mode of seating;

(f) a first tensioning means operatively associated with each of the forwardly extending members for yieldably biasing of the pair of upright arms to a spaced-apart, at rest position, and structured so as to provide an arcuate range of motion, and for allowing return of said pair of upright arms upon release of the biasing effort; and (g) a combined chest press and leg press exercise subassembly located proximal to the rearward longitudinal end of the elongate frame member, and useable while having the seating component pivoted to, and locked in, the rearwardly-facing mode; such subassembly further comprising:

(i) a substantially vertical mast secured pivotally at its lower longitudinal end proximal to the rearward longitudinal end of the elongate frame member;

(ii) a horizontally oriented, third cross member secured centrally of and being proximal to the upper longitudinal end of the vertical mast; and (iii) a second tensioning means operatively linked between a first anchor point located intermediate of the longitudinal ends of the vertical mast and a lower second anchor point located intermediate of the rearwardly facing longitudinal end of the frame member and the seating component, with such tensioning means normally biasing the vertical mast towards the seating component and further configured for bench pressing by moving the mast in an arcuate range of motion against the second tensioning means as initiated by the user arms.

* * * * *